US007581423B2

(12) United States Patent
Brojanac et al.

(10) Patent No.: US 7,581,423 B2
(45) Date of Patent: Sep. 1, 2009

(54) PROTECTIVE COVER FOR A LOCK

(75) Inventors: Mike Brojanac, Jackson, WI (US); Gary Burmesch, Port Washington, WI (US); Frank Scott, Milwaukee, WI (US)

(73) Assignee: Master Lock Company LLC, Oak Creek, WI (US)

( * ) Notice: Subject to any disclaimer, the term of this patent is extended or adjusted under 35 U.S.C. 154(b) by 345 days.

(21) Appl. No.: 11/416,290

(22) Filed: May 2, 2006

(65) Prior Publication Data

US 2006/0266090 A1 Nov. 30, 2006

Related U.S. Application Data

(60) Provisional application No. 60/677,459, filed on May 3, 2005.

(51) Int. Cl.
*E05B 17/18* (2006.01)

(52) U.S. Cl. ..... 70/455; 70/52; 70/56; 70/423; 70/427; 70/454; 70/DIG. 43

(58) Field of Classification Search ..... 70/20, 70/31, 52, 54, 55, 56, 454, 455, DIG. 43, 70/70, 423, 427
See application file for complete search history.

(56) References Cited

U.S. PATENT DOCUMENTS 1,560,868 A * 11/1925 Shinn ..... 70/455
2,655,031 A * 10/1953 Jacobi ..... 70/455
2,906,112 A * 9/1959 Vahlstrom ..... 70/455
3,263,463 A * 8/1966 Duval et al. ..... 70/455
3,777,522 A * 12/1973 Rubner ..... 70/455
4,218,902 A 8/1980 Druschel (Continued)

FOREIGN PATENT DOCUMENTS

EP 0 320 516 A1 6/1989

OTHER PUBLICATIONS

International Preliminary Report on Patentability and Written Opinion from PCT/US2006/16692 dated Sep. 25, 2007.

*Primary Examiner*—Peter M Cuomo
*Assistant Examiner*—Christopher Boswell
(74) *Attorney, Agent, or Firm*—Calfee, Halter & Griswold LLP

(57) ABSTRACT

A protective cover for a keyway disposed on an end surface of a lock is provided. A housing is adapted to be assembled over the lock end surface. The housing includes an opening that surrounds the keyway. At least one door is disposed in the housing opening. The door includes an edge for aligning with the keyway in a key insertion position. When a key is pressed against the door, the door moves away from the keyway, providing a key opening in the housing opening for insertion of the key into the keyway. At least one door biasing member engages the door and biases the edge of the door toward the keyway. The door is mounted on a pivot member disposed in the housing opening such that the pivot member and door pivot within the opening when the key is inserted into the keyway and turned in the lock. At least one pivot biasing member engages the pivot member to hold the edge of the door in alignment with the keyway when the keyway is in the key insertion position.

10 Claims, 10 Drawing Sheets

U.S. PATENT DOCUMENTS

| | | | | | |
|---|---|---|---|---|---|
| 4,317,344 | A | | 3/1982 | Barnard | |
| 4,594,866 | A | * | 6/1986 | Neyret | 70/455 |
| 4,638,652 | A | * | 1/1987 | Morse et al. | 70/455 |
| 4,790,163 | A | | 12/1988 | Appelbaum | |
| 5,033,279 | A | | 7/1991 | Lebrecht | |
| 5,156,029 | A | | 10/1992 | Heald | |
| 5,934,121 | A | * | 8/1999 | Chen | 70/455 |
| 5,946,957 | A | * | 9/1999 | Yamamoto et al. | 70/455 |
| 6,209,369 | B1 | * | 4/2001 | Freck | 70/455 |
| 6,305,198 | B1 | | 10/2001 | Chastain et al. | |
| 6,393,876 | B1 | * | 5/2002 | Matyko | 70/56 |
| 6,397,647 | B1 | | 6/2002 | Kuo | |
| 6,813,914 | B2 | | 11/2004 | Chen | |

* cited by examiner

PROTECTIVE COVER FOR A LOCK

CROSS REFERENCE TO RELATED APPLICATIONS

This application claims the benefit of U.S. Provisional Patent Application No. 60/677,459, filed May 3, 2005, the entire disclosure of which is hereby incorporated by reference.

FIELD OF THE INVENTION

The present invention relates generally to a protective cover for a lock, and more particularly to a flexible cover for a padlock adapted to enhance corrosion resistance of the lock body and to seal openings from moisture and other contaminants.

BACKGROUND OF THE INVENTION

Due to the many outdoor uses of padlocks, protective covers have been proposed to minimize the exposure of the padlock, particularly the keyway and the internal components of the padlock, to moisture and other contaminants, in an effort to extend service life by minimizing corrosion or oxidation of metallic lock components and damage caused by contamination. Previously proposed covers have been provided with a top portion to be fitted over the top end of the lock body, with openings to accommodate the shackle, and a bottom portion to be fitted over the bottom end of the lock body. However, the presence of a slit between the shackle openings, or sealing surfaces that deflect downward towards the shackles, may allow moisture to accumulate on the top portion of the cover and eventually seep past the cover and into the shackle holes.

To open the lock, the bottom portion of the previously proposed covers may be removed to access the keyway, or the bottom portion may be provided with an opening to access the keyway without removing the bottom portion. The opening in some proposed covers has been limited to a slit in the flexible bottom portion, allowing the material at the slit to be pressed open when a key is pressed against the slit for insertion in the keyway, or allowing the slit to be opened by squeezing the ends of the cover, similar to the operation of a plastic coin purse. After the key is removed from the lock, the slit contracts to its original form. However, this type of slit in the bottom cover may still allow moisture or other contamination to enter the keyway through the slit, particularly if repeated unlocking of the lock has resulted in plastic deformation of the cover material, causing the slit to widen.

SUMMARY OF THE INVENTION

The present invention relates to a protective cover for a lock, in which exposure of the internal and external surfaces of the lock body to moisture and contamination are minimized.

In one embodiment, a protective cover for a keyway disposed on an end surface of a lock is provided. A housing is adapted to be assembled over the lock end surface. The housing includes an opening that surrounds the keyway. At least one door is disposed in the housing opening. The door includes an edge for aligning with the keyway in a key insertion position. When a key is pressed against the door, the door moves away from the keyway, providing a key opening in the housing opening for insertion of the key into the keyway. At least one door biasing member engages the door and biases the edge of the door toward the keyway. The door is mounted on a pivot member disposed in the housing opening such that the pivot member and door pivot within the opening when the key is inserted into the keyway and turned in the lock. At least one pivot biasing member engages the pivot member to hold the edge of the door in alignment with the keyway when the keyway is in the key insertion position.

In another embodiment, a protective cover is provided for a padlock having a lock body with a top end, a bottom end, and vertical sides therebetween, a keyway disposed on the bottom end, and a shackle extending from first and second shackle holes in the top end. The protective cover includes a top cover member sized to fit over the top end of the lock body. The top cover member has an upper portion for covering the top end and a side wall portion for covering at least a portion of the vertical sides of the lock body. The upper portion includes first and second shackle hole openings that align with the first and second shackle holes for receiving the shackle. First and second annular shackle seals are sized to fit around first and second legs of the shackle, and an outer portion of each of the first and second shackle seals is adapted to be retained in the first and second shackle hole openings of the top cover member.

BRIEF DESCRIPTION OF DRAWINGS

The present invention will be more fully understood by reference to the following detailed description of the invention and the accompanying drawings. The drawings represent exemplary embodiments of the present invention and are included for illustrative purposes in order to facilitate understanding of the description. Other embodiments of the present invention contemplated by the description are included within this application.

DETAILED DESCRIPTION

Figure 2:
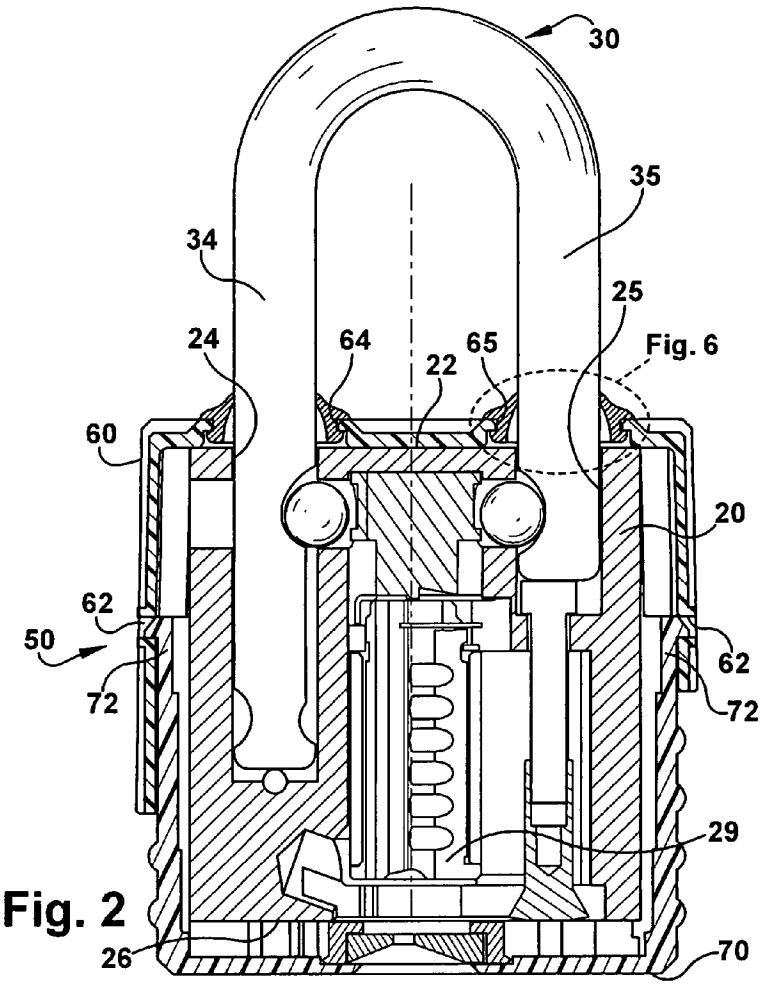
FIG. 2 is a cross-sectional view of a padlock with a protective cover.
Figure 1:
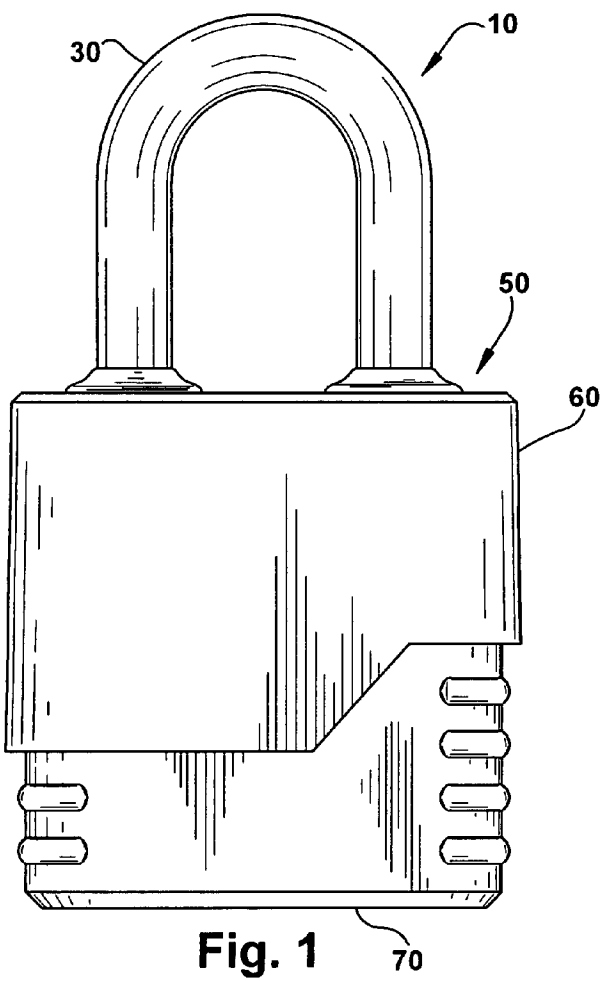
FIG. 1 is a front view of a padlock with a protective cover.

The Detailed Description of the Invention merely describes preferred embodiments of the invention and is not intended to limit the scope of the claims in any way. Indeed, the invention as described by the claims is broader than and unlimited by the preferred embodiments, and the terms in the claims have their full ordinary meaning.

The present invention provides a protective cover for a lock, such as, for example, a padlock. The protective cover may serve any one or more of a variety of purposes, such as, for example, improving impact resistance for one or more lock components, providing color coding or other visual identification for one or more locks, providing corrosion resistance for external surfaces of the lock, or providing external seals to minimize or eliminate the entry of moisture, debris, or other contaminants into the lock through cracks, seams, or other openings in the lock, such as, for example, a keyway or shackle holes.

FIGS. 1-4 illustrate a padlock 10 with a protective cover 50 according to an exemplary embodiment of the invention. While the figures illustrate the use of the exemplary protective cover with a padlock, any one or more of the features of the exemplary embodiments may be used on different types of locks, including, for example, combination locks, tool locks, shackle-less locks, etc. The padlock 10 includes a lock body 20, a shackle 30 extending from shackle holes 24, 25 disposed in a top end 22 of the lock body 20, and a keyway 28 extending from a bottom end 26 of the lock body 20 through a cylinder 29 disposed in the lock body. The shackle 30 includes a longer shackle leg 34 that remains engaged with the shackle hole 24 when the lock is in use, and a shorter shackle leg 35 that is withdrawn from shackle hole 35 when the padlock in unlocked. To unlock the padlock 10 of the exemplary embodiment, a key (not shown) is inserted through the keyway 28 into the cylinder 29, and the key is turned to rotate the cylinder 29 from a locked position to an unlocked position, thereby releasing the shackle 30 for withdrawal of the shorter shackle leg 35. To remove the key, the exemplary embodiment may require that the key, and with it, the cylinder 29, be turned back to the locked position to release the key for withdrawal.

The protective cover 50 of the exemplary embodiment includes a top cover member 60 and a bottom cover member 70. However, other embodiments of the invention include one piece protective covers assembled over the top portion or the bottom portion of a lock. The top and bottom cover members 60, 70 may be provided in a resilient, flexible material, such as, for example, polymers such as nylon or polypropylene, or elastomers such as Santoprene®. The use of a flexible material may allow one or both of the top and bottom cover members 60, 70 to be sized to provide a slight interference fit between the cover and the lock body 20, to provide a stronger grip and a tighter seal between the cover 50 and the lock body 20. In one embodiment, one or both of the top and bottom cover members 60, 70 may be constructed from two or more different materials, such as, for example, inner and outer layers of polymeric material molded with a two-shot molding process. In an exemplary embodiment, the top cover may be provided with an inner layer of glass filled, impact copolymer polypropylene and an outer later of Santoprene®, a thermoplastic elastomer that adheres well to polypropylene; and the bottom cover may be provided in rubberized nylon, a durable, impact resistant material.

Figure 3:
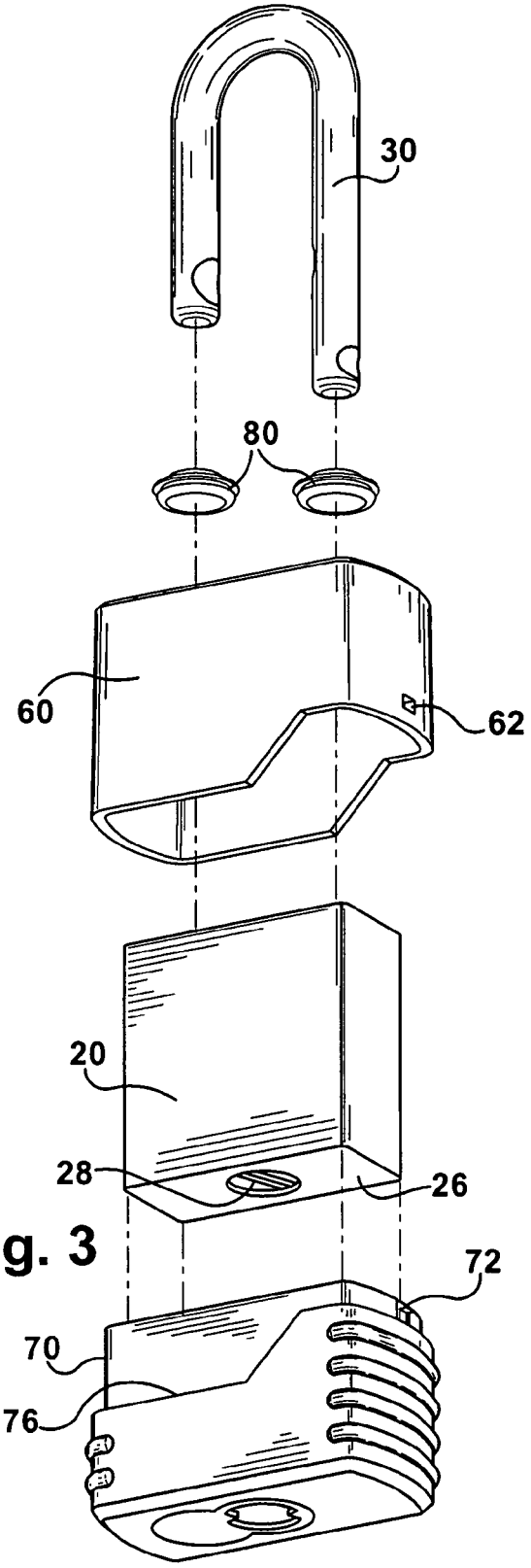
FIG. 3 is an exploded perspective view of a padlock with a protective cover.
Figure 4:
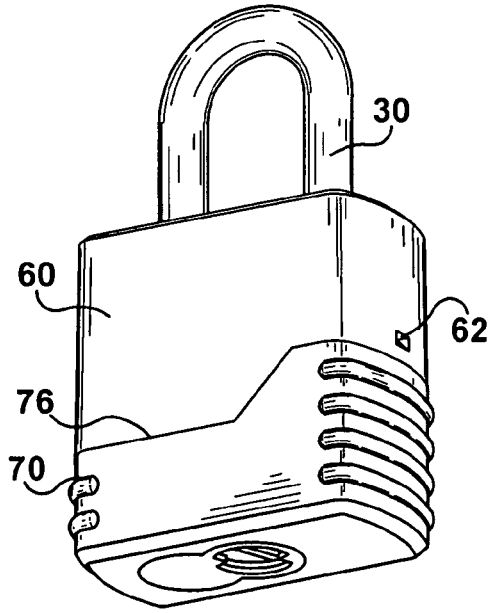
FIG. 4 is a perspective view of the padlock and protective cover of FIG. 3.

In the exemplary embodiment of FIGS. 1-4, a side wall portion of the top cover member 60 overlaps a side wall portion of the bottom cover member 70 when assembled to the lock body 20. Alternatively, the bottom cover member could overlap the top cover member (not shown). The elimination of an open seam or gap between the top cover member 60 and bottom cover member 70 further minimizes the potential entry of moisture and other contaminants past the cover 50 and onto the lock body and its openings. As shown in FIGS. 3 and 4, the bottom cover member 70 may be provided with a ridgeline 76 between a thicker lower portion of the side wall and a thinner upper portion of the side wall. The ridgeline 76 provides coverage for the inner layer of material of the top cover member (if two layers of material are used), and also provides a flush seam between the overlapping cover members. As shown in FIGS. 2 and 3, the top and bottom cover members 60, 70 may be provided with one or more slots 62 and locking tabs 72 for holding the top and bottom cover members 60, 70 together on the lock body 20, and preventing the bottom cover member 70 from sliding down or off the body 20. While the exemplary embodiment provides slots 62 on each end of the top cover member 60 and corresponding locking tabs 72 on each end of the bottom cover member 70, one or more slots may be provided on the bottom cover member 70 with one or more locking tabs on the top cover member 60. Further, other means of connecting the top and bottom portions may be provided, such as, for example, snaps, clips, or other fasteners.

Figure 5:
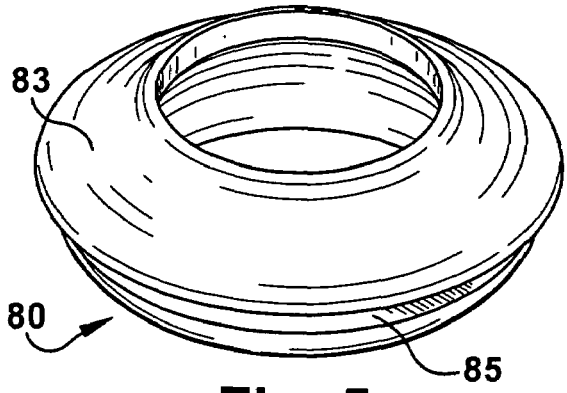
FIG. 5 is a perspective view of a shackle seal.

Flexible shackle seals may be provided at the shackle holes to minimize the entry of moisture and other contamination past the top cover member 60 and the shackle 30 and into the shackle holes 24, 25 in the lock body 20. For example, the shackle seals may be shaped to prevent moisture or contaminants from collecting around the edges of the shackle holes. In an exemplary embodiment, as shown most clearly in FIGS. 3, 5 and 6, a pair of annular shackle seals 80 are provided for installation around shackle legs 34, 35 and retention in shackle openings 64, 65 in the top cover member 60. Each shackle seal 80 may be provided with a circumferential slot or groove 85 around the outside diameter of the seal 80, which receives a corresponding inner edge of the shackle opening 64, 65 for interlocking engagement. The cover member 60 may be provided with undercuts 66 formed around the edges of the shackle openings 64, 65 for retaining the shackle seals 80.

Figure 6:
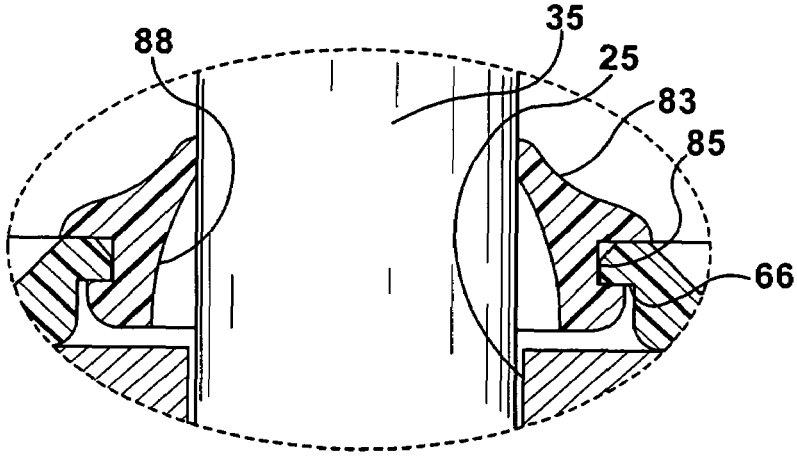
FIG. 6 is an enlarged partial cross-sectional view of the padlock, protective cover, and shackle seal of FIG. 2.

The shackle seals 80 may be further provided with a contoured, generally frustoconical upper surface 83, which overhangs the groove 85 to prevent moisture or contamination from seeping past the groove 85 and beneath the cover 60. The frustoconical shape of the upper surface also prevents moisture from collecting or pooling around the shackle legs 34, 35 on the top cover member 60. Further, a tight interference fit between the inner edge of the upper surface 83 and the shackle leg 34, 35 enables the shackle seal to wipe or scrape away moisture and contaminants from the outer surfaces of the shackle legs 34, 35 when the shackle 30 is returned to locking engagement with the lock body 20. Further still, a contoured inner diameter 88 of the shackle seal 80, as shown in FIG. 6, may be provided to allow for a gap between the shackle leg 34, 35 and the base of the shackle seal 80, allowing the seal 80 to float and flex in the shackle openings 64, 65 to accommodate variations in shackle leg size, roundness, and spacing. In assembling an exemplary embodiment of the protective cover to a corresponding padlock, the shackle seals 80 may be pressed or snapped into the shackle openings 65 of the top cover member 60 prior to assembly of the top cover member over the lock body. The shackle seals may be provided in a flexible material, such as, for example, an elastomer. In an exemplary embodiment, the shackle seals are provided in Hytrel®, a polyester elastomer known for its chemical resistance properties.

The bottom cover member 70, or any protective cover over a lock end surface on which a keyway is disposed, may be provided with a fixed opening for access to the keyway in both locked and unlocked positions. The cover member may also be provided without an opening, thereby requiring removal of the cover member prior to unlocking. However, to further minimize access to the opening by moisture and other contaminants, a movable keyway door may be provided, which covers the keyway when the cover member is assembled to the lock, but may be opened to provide a key opening to permit access to the keyway when unlocking the lock. In some applications, it may be advantageous to limit movement of the door to a direction substantially parallel with the surface of the lock, such as sliding or pivoting movement to minimize the required gap between the door and the keyway. Further, the use of a movable rigid door, instead of a deformable slot, may allow for longer service life for the cover, as gradual plastic deformation of a slot-like opening may result in a larger opening for moisture and contaminants to enter. The exemplary embodiments of FIGS. 7-17 illustrate mechanisms for providing a movable rigid keyway door that may be opened to allow for insertion of a key into the keyway.

Figure 7:
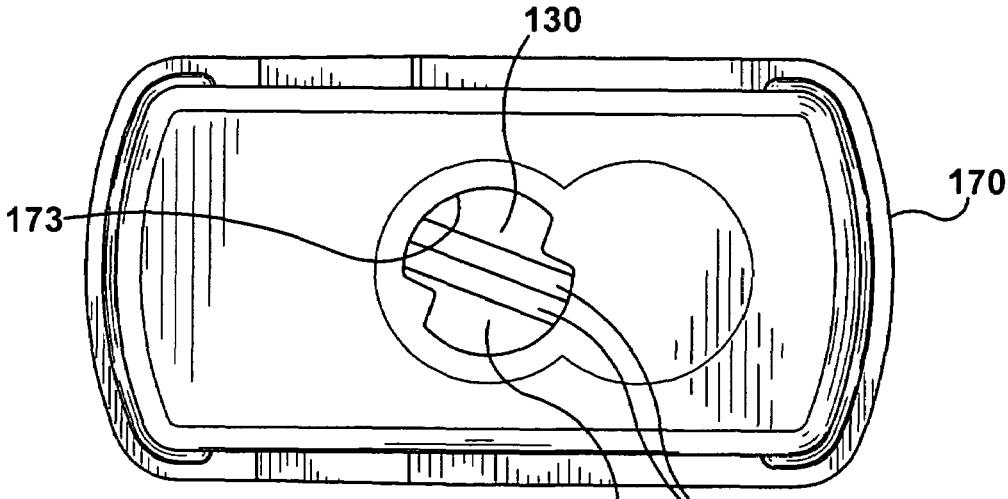
FIG. 7 is a bottom view of a protective cover with a keyway door assembly for a lock.
Figure 8A:
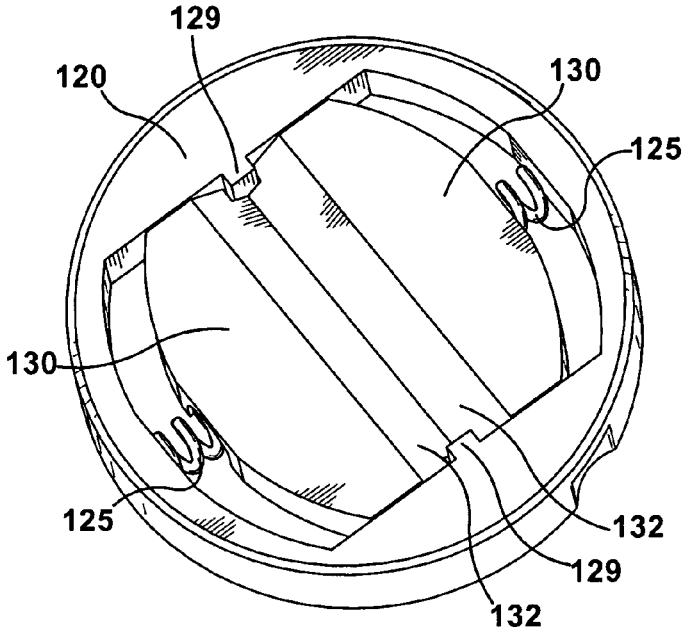
FIG. 8A is a perspective view of a keyway door assembly for a lock.
Figure 8B:
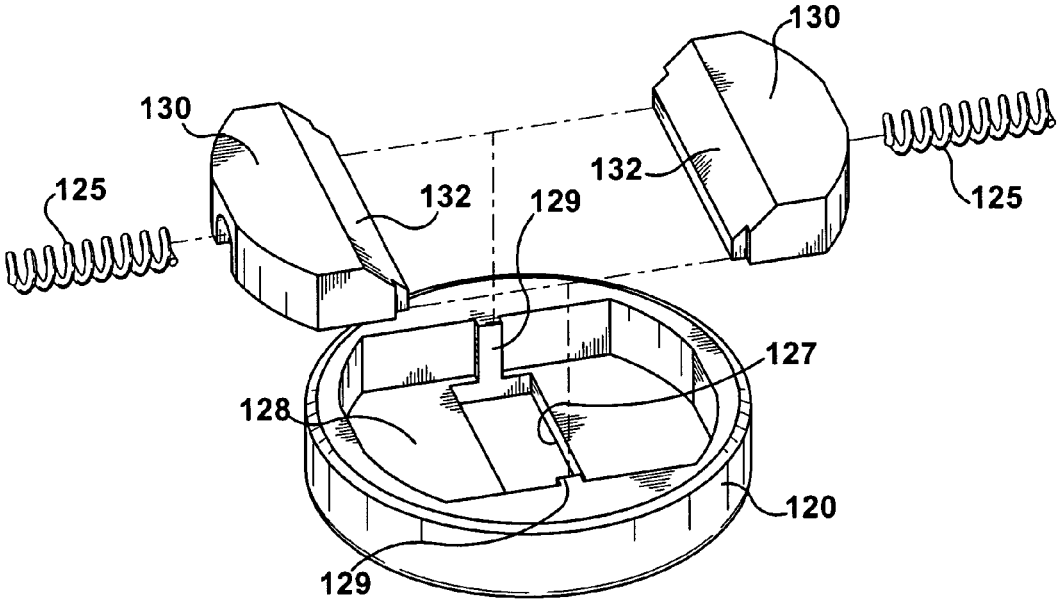
FIG. 8B is an exploded perspective view of the keyway door assembly of FIG. 8A.

In the exemplary embodiment of FIG. 7, a pair of doors 130 are provided for covering the keyway of the lock. In an exemplary embodiment, as shown in FIGS. 8A and 8B, the doors 130 may be slidably mounted in a pivot member or door retaining member 120. The door retaining member 120 is aligned with an opening 173 of a cover member 170 such that the doors 130 cover a keyway of a lock when the cover member 170 is assembled to the lock. The opening 173 may be a cut-out in the cover member 170, limited in size and/or shape as required by the range of motion of the key within the lock, as shown in FIG. 7. The door retaining member 120 includes door biasing members, such as, for example, compression springs 125, shown in FIGS. 8A and 8B, which bias the doors 130 towards each other in a closing direction. The doors 130 of the exemplary embodiment are provided with inner edges 132 facing away from the keyway. When a key (not shown) is pressed against the doors 130, the force applied overcomes the biasing forces of the door biasing members 125, pushing the doors 130 apart to provide an opening for the key, and access to the keyway.

Many different mechanisms may be provided to enable the doors to open against the door biasing members when the key is pressed against the door or doors, such as, for example, a small gap adjacent to the door edge into which a pointed end of the key may be received, or a hinge on each door to allow the doors to tilt in toward the lock body to provide a key opening. In one embodiment, as shown in FIGS. 8A and 8B, the edges 132 of the doors 130 may be chamfered, such that an axial force applied to the chamfered surfaces may be directed to provide lateral movement of the doors 130 in an opening direction. While the chamfered portions of the edges 132 of the illustrated embodiment are flat surfaces extending from outer surfaces of the doors at about a 45° angle, the chamfered surface may take any of a wide variety of contours and/or angles sufficient to direct an axial force applied to the doors to provide lateral movement of the doors in an opening direction. Further, while the exemplary embodiments illustrated in FIGS. 7-17 is a two door design, other embodiments of the invention may be provided with only one door, or with more than two doors (not shown).

The doors may be provided in a relatively hard, wear resistant material that is resistant to damage or deformation. In an exemplary embodiment, the door or doors are provided in a glass filled nylon, such as, for example, a 33% glass filled nylon.

In the exemplary embodiment of FIGS. 8A and 8B, the door retaining member 120 includes a slot 127 that aligns with the chamfered edges 132 of the doors 130, to allow a key to be inserted through the door retaining member 120, while providing a base 128 to support the doors 130. A ridge 129 is provided at each end of the slot 127 to provide a positive stop for each door 130 in the closed position, thereby preventing the door biasing members 125 from forcing the doors 130 to overlap or misalign in the door retaining member 120. The door retaining member may be provided in a relatively hard, wear resistant material that is resistant to damage or deformation. In an exemplary embodiment, the door retaining member is provided in a glass filled nylon, such as, for example, a 33% glass filled nylon.

Figure 9A:
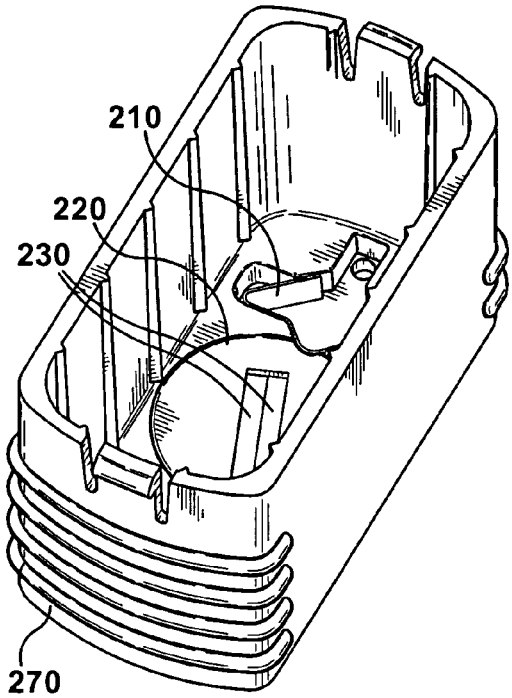
FIG. 9A is a perspective view of a protective cover with a keyway door assembly for a lock.
Figure 11:
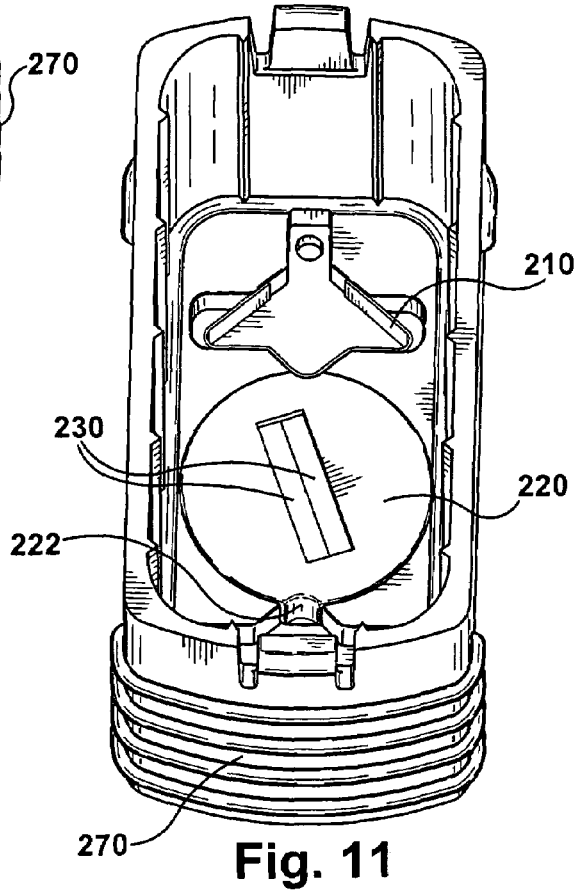
FIG. 11 is a perspective view of the protective cover of FIG. 9A, with the keyway door assembly returned to a locked position.

To allow the inserted key to be turned in the lock, the door retaining member 120 may allow for sufficient slideable movement of the doors 130 against the door biasing members 125 to provide a key opening wide enough (i.e., the width of a key blade) for the key to fully rotate between the edges 132 of the doors 130. However, to minimize the size of the key opening and resulting exposure of the lock during use of a key, as shown in FIGS. 9A-11, the door retaining member 220 may be permitted to pivot with respect to the cover member 270 when the key is inserted past the doors 230 and turned with the keyway, substantially limiting the key opening to the thickness of the key blade. To prevent the door retaining member 220 from being loose in the cover member 270 and misaligning with the keyway when the key is not inserted, one or more recesses or detents 222 and corresponding pivot biasing members 210 may be provided to hold the door retaining member 220 such that the retaining member slot 227 (FIG. 9C) and the edges of the doors 230 are in alignment with the keyway in a locked position prior to key insertion and rotation. The pivot biasing members 210 may be retained in corresponding recesses in the cover 270, as shown in FIGS. 9A-11. The pivot biasing members 210 engage the detents 222 when the door retaining member 220 is aligned with the locked position of the keyway, as shown in FIGS. 9A and 11. This engagement requires deliberate turning force of a key A (FIG. 10) in the keyway to disengage the pivot biasing members 210 from the detents 222 and pivot the door retaining member 220. While FIGS. 9A-11 show detents 222 in the door retaining member 220 and corresponding flat wire spring pivot biasing members 210, another embodiment may be provided with one or more detents disposed on a surface of the cover member and one or more corresponding pivot biasing members disposed on the door retaining member.

Figure 9B:
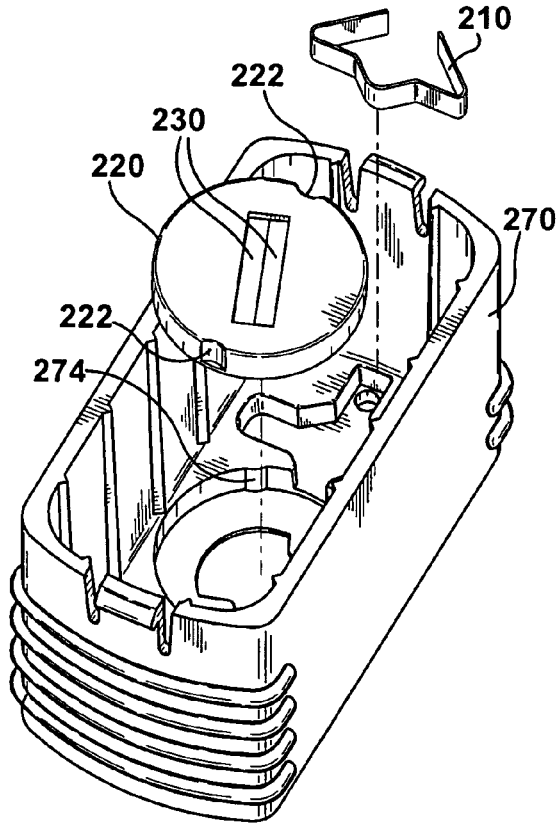
FIG. 9B is an exploded perspective view of the protective cover of FIG. 9A.
Figure 9C:
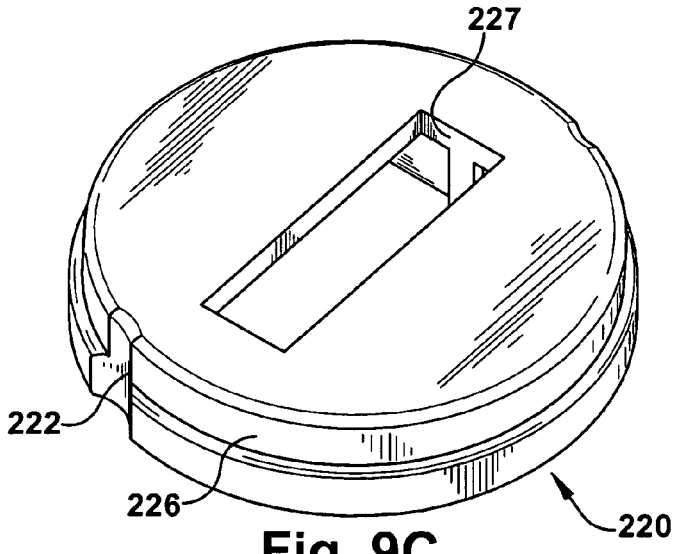
FIG. 9C is a perspective view of the door retaining member of FIG. 9A.
Figure 10:
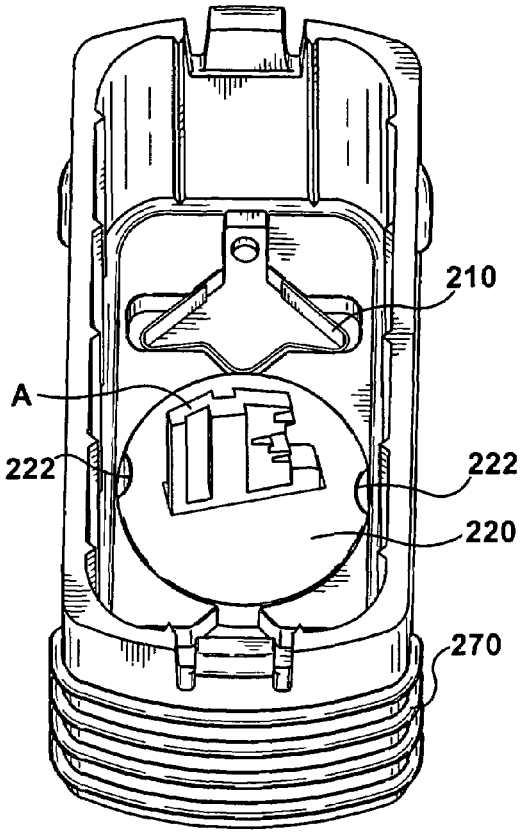
FIG. 10 is a perspective view of the protective cover of FIG. 9A, with a key inserted through the keyway door assembly and the keyway door assembly pivoted to an unlocked position.

To retain the door retaining member 220 and doors 230 in the cover 270 during assembly, cover removal, or maintenance of the lock, one or more retaining ribs 274 may be provided in the bottom cover opening to engage the corresponding detents 222 in the door retaining member 220 in an assembly position of the door retaining member 220, as shown in FIG. 9B. To accommodate the retaining ribs 274, an outer circumference of the door retaining member 220 may be provided with a recess 226 to provide clearance for rotation of the door retaining member 220.

Figure 12A:
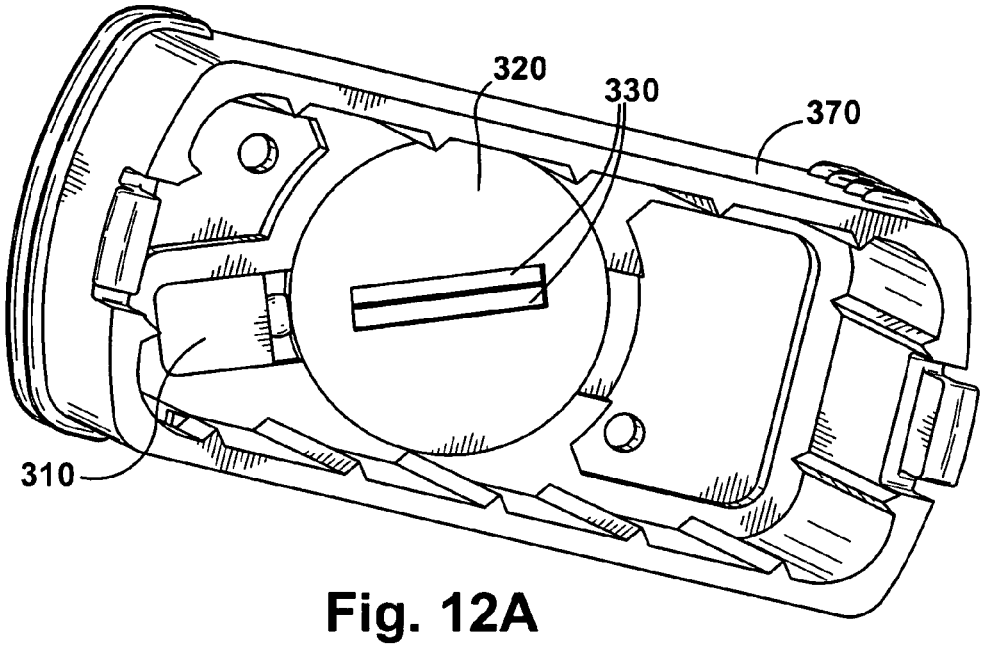
FIG. 12A is a perspective view of a protective cover with another keyway door assembly.
Figure 12B:
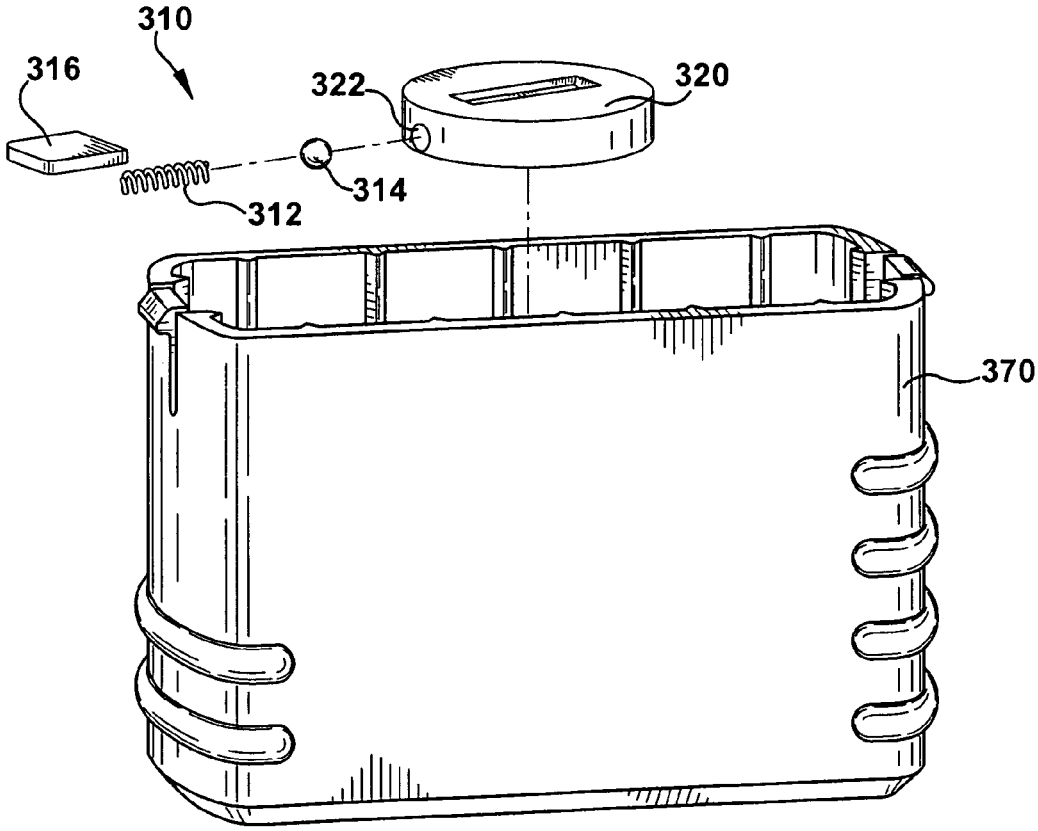
FIG. 12B is an exploded perspective view of the protective cover of FIG. 12A.

In another embodiment, shown in FIGS. 12A and 12B, the pivot biasing member 310 includes a compression spring 312, ball 314, and housing 316. The spring 312 biases the ball 314 against the door retaining member 320. The ball is partially received in a corresponding detent 322 of the door retaining member 320 when the door retaining member 320 is positioned to align the edges of the doors 330 with the keyway in the locked position.

Figure 13A:
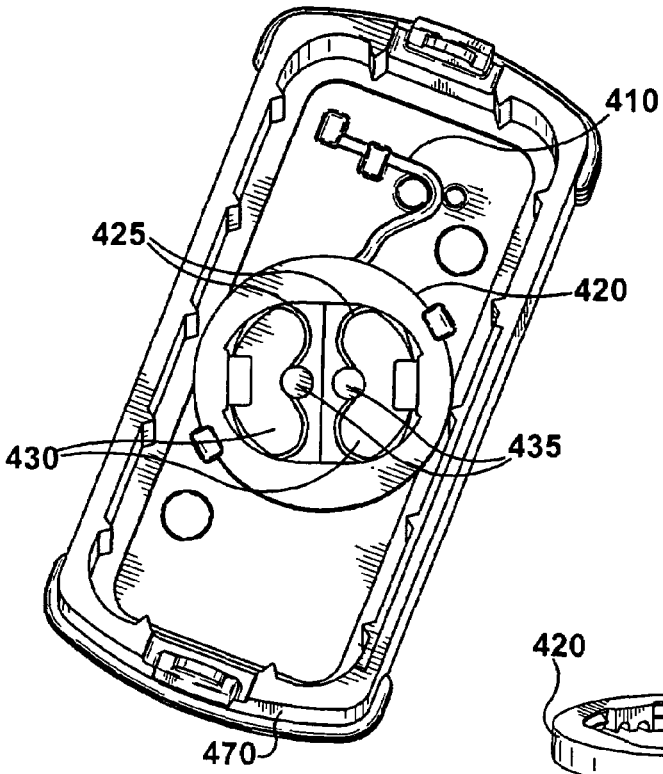
FIG. 13A is a top view of a protective cover with another keyway door assembly.
Figure 13B:
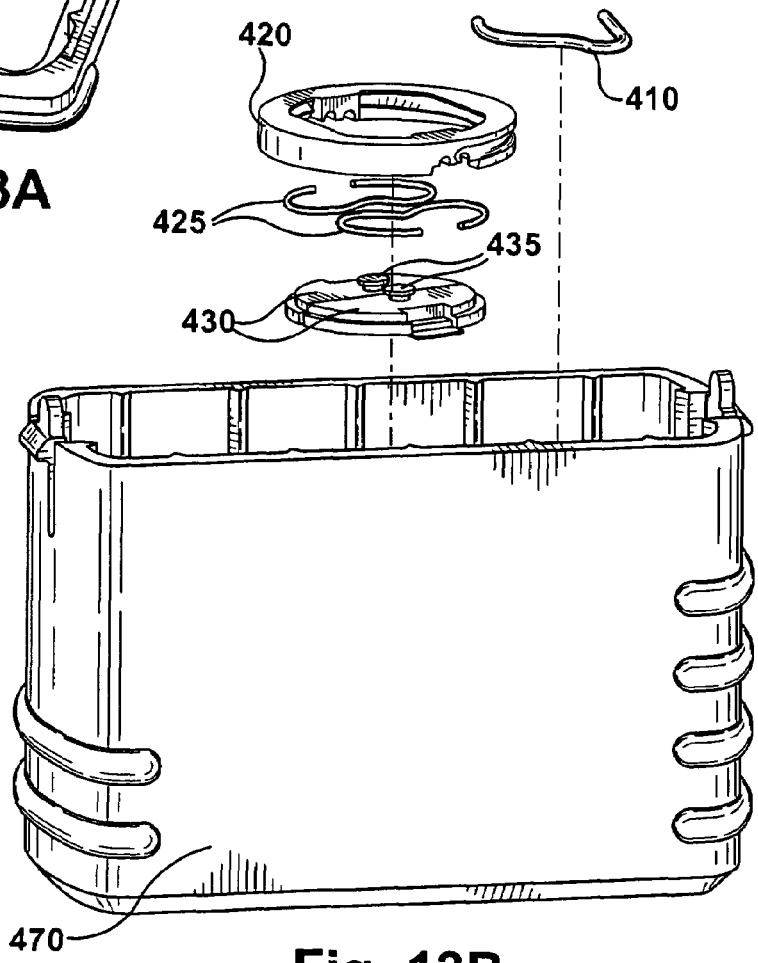
FIG. 13B is an exploded side perspective view of the protective cover of FIG. 13A.

In still another embodiment, shown in FIGS. 13A and 13B, the door biasing members comprise flat wire springs 425 retained by the door retaining member 420. The springs engage raised buttons 435 on rear sides of the doors 430 to bias the doors 430 towards a closed position. Additionally, the pivot biasing member comprises a bent flat wire spring 410 assembled with the cover member 470 and biased against the door retaining member 420 to engage a corresponding detent in the door retaining member 420 when the door edges are aligned with the locked keyway position.

Figure 14:
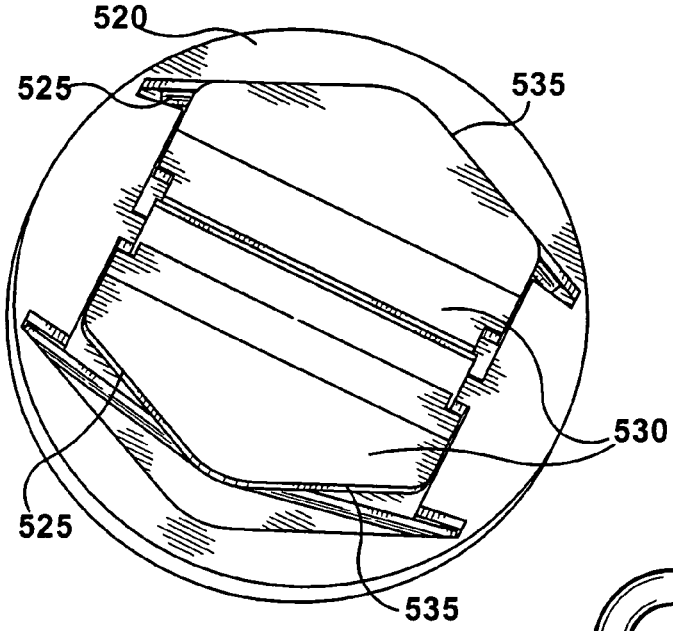
FIG. 14 is a bottom perspective view of another keyway door assembly.

In still another embodiment, as shown in FIG. 14, the door biasing members comprise flat wire springs 525 retained by the door retaining member 520. The springs engage rear edges 535 of the doors 530 to bias the doors 530 towards a closed position.

Figure 15:
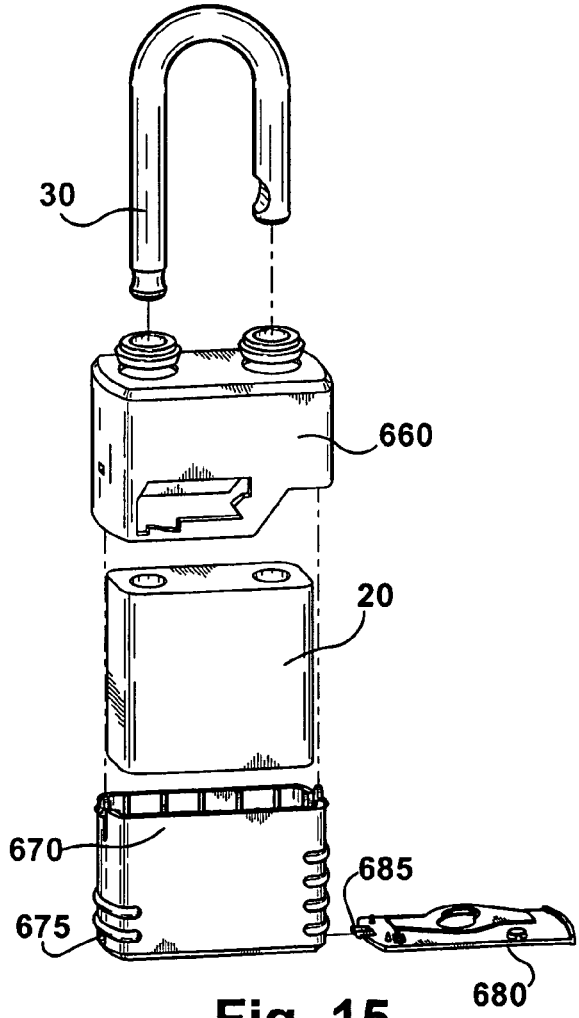
FIG. 15 is an exploded perspective view of a padlock and a protective cover having top and bottom portions, in which the bottom portion has a detachable bottom plate.
Figure 16:
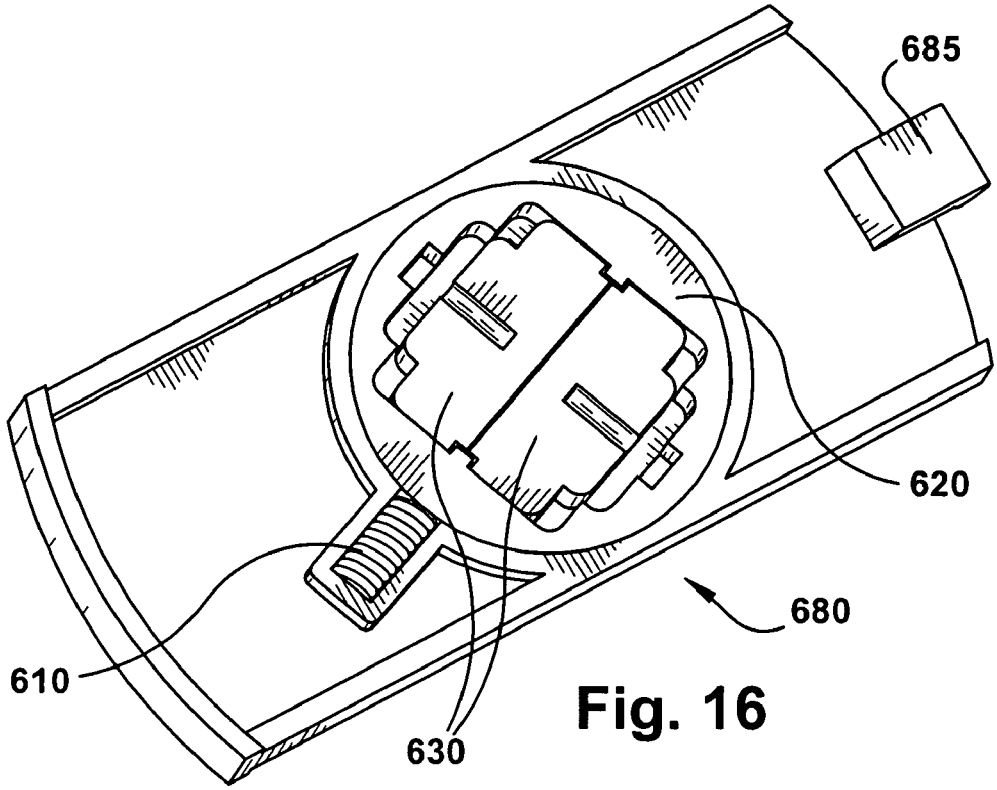
FIG. 16 is a top view of a detachable bottom plate.
Figure 17:
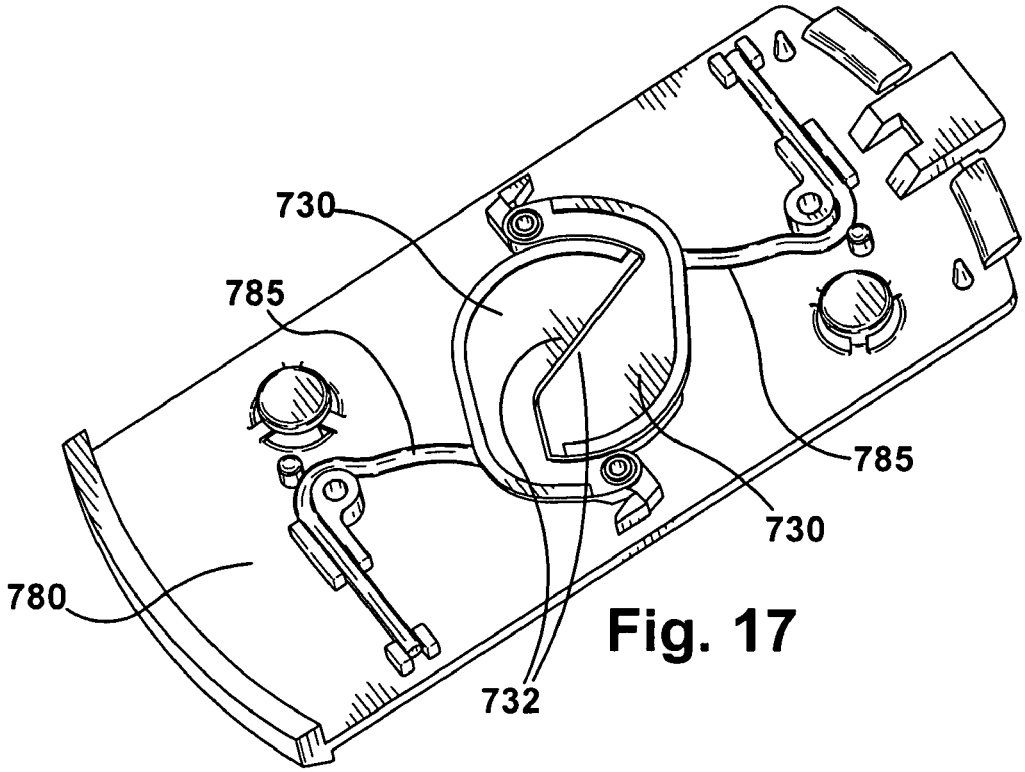
FIG. 17 is a top view of another detachable bottom plate.

As shown in FIGS. 10-13, the door retaining member and doors for covering the keyway may be disposed in a bottom cover member 270, 370, 470 for assembly to a padlock along with a top cover member 60 (see FIGS. 1-4) to which the bottom cover member may be connected. However, the keyway door mechanism as described herein may be provided with any type of cover member for use with many types of locks, including, for example, a door lock, shackle-less lock, or tool lock. Additionally, as used with a padlock or similar type of lock, the keyway door mechanism may be provided in a separate bottom plate 680, as shown in FIGS. 15-17. This bottom plate 680 may be attached to the open bottom of a cover member 670, as shown in FIG. 15, by a slot 675 and locking tab 685 engagement, or by any suitable clips, snaps, fasteners, or other mechanisms (not shown). Alternatively, the bottom plate may be attached directly to the bottom keyway surface of the lock body 20, and a bottom cover member having an opening aligning with the door mechanism (not shown) may, but need not, be assembled to the lock body 20 over the bottom plate 680.

In one such embodiment, illustrated in FIG. 16, the bottom plate assembly 680 includes door retaining member 620, doors 630, door biasing member (not shown), and pivot biasing member 610 such as those shown in the embodiment of FIGS. 12A and 12B. Alternatively, doors may be pivotally connected directly to the bottom plate. In the exemplary embodiment of FIG. 17, the doors 730 are pivotally connected to the plate 780 on opposite sides of the opening, with edges 732 angled such that when the doors 730 are pushed open by applying force to the doors, both doors 730 rotate in the same direction and produce a generally rectangular key opening that widens to accommodate the turning of the key. Door biasing members, such as flat wire springs 785 in the exemplary embodiment, are assembled with the bottom plate 780 to bias the doors 730 towards the closed position, causing the doors 730 to automatically close when the key is withdrawn. It should be noted that a door mechanism utilizing one or more pivotally connected doors may also be provided with the bottom cover members 70 of FIGS. 1-4 and as described above.

The detailed description has been provided for clearness of understanding of the present invention and is not intended to unnecessarily limit the scope of the invention. Modifications will be obvious to those of ordinary skill in the art, and such modifications are intended to be included as part of this invention.

What is claimed is:

1. A protective cover for a keyway disposed on an end surface of a lock, the protective cover comprising:

a housing, adapted to be assembled over the end surface, the housing including an opening that surrounds the keyway when the housing is assembled over the end surface;

at least one door, disposed in the housing opening, the at least one door having an edge adapted to align with the keyway in a key insertion position, wherein the at least one door is adapted to move away from the keyway when a key is pressed against the at least one door, such that a key opening in the housing opening is provided for insertion of the key into the keyway;

at least one door biasing member that engages the at least one door and biases the edge of the at least one door toward the keyway;

a pivot member disposed in the housing opening, the at least one door being mounted on the pivot member, wherein the pivot member and the at least one door are adapted to pivot within the housing opening when the key is inserted into the keyway and turned in the lock; and at least one pivot biasing member that engages the pivot member to hold the edge of the at least one door in rotational alignment with the keyway when the keyway is in the key insertion position;

wherein the pivot member comprises at least one detent that aligns with and receives at least a portion of the at least one pivot biasing member when the edge of the at least one door is aligned with the keyway in the key insertion position.

2. The protective cover of claim 1, wherein the edge of the at least one door is chamfered.

3. The protective cover of claim 1, wherein the protective cover is adapted to limit movement of the at least one door to a direction substantially parallel to the lock end surface.

4. The protective cover of claim 1, comprising two doors and two door biasing members, wherein the door biasing members bias the doors towards each other to cover the keyway.

5. The protective cover of claim 1, comprising two pivot biasing members and two corresponding detents.

6. The protective cover of claim 1, wherein the at least one door biasing member comprises a compression spring.

7. The protective cover of claim 1, wherein the at least one door biasing member comprises a flat wire spring.

8. The protective cover of claim 1, wherein the at least one pivot biasing member comprises a compression spring.

9. The protective cover of claim 1, wherein the at least one pivot biasing member comprises a flat wire spring.

10. The protective cover of claim 1, wherein the pivot member is assembled to an inner side of the housing such that at least a portion of the pivot member is covered by the housing when the housing is assembled over the lock end surface.

* * * * *

UNITED STATES PATENT AND TRADEMARK OFFICE

CERTIFICATE OF CORRECTION

PATENT NO. : 7,581,423 B2
APPLICATION NO. : 11/416290
DATED : September 1, 2009
INVENTOR(S) : Brojanac et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 467 days.

Signed and Sealed this

Fourteenth Day of September, 2010

David J. Kappos

David J. Kappos
*Director of the United States Patent and Trademark Office*